United States Patent [19]

Jain et al.

[11] 4,287,073

[45] Sep. 1, 1981

[54] WATER-BASED FORGING LUBRICANT

[75] Inventors: Sulekh C. Jain, Shrewsbury; Charles A. Morris, Grafton, both of Mass.

[73] Assignee: Wyman-Gordon Company, Worcester, Mass.

[21] Appl. No.: 910,842

[22] Filed: May 30, 1978

Related U.S. Application Data

[60] Division of Ser. No. 712,702, Aug. 9, 1976, Pat. No. 4,104,178, which is a continuation of Ser. No. 625,592, Nov. 24, 1975, Pat. No. 3,983,042.

[51] Int. Cl.[3] ..... C10M 3/14; C10M 3/04; C10M 3/02

[52] U.S. Cl. ..... 252/30; 72/42; 252/25; 252/49.3; 252/49.5

[58] Field of Search ..... 252/18, 30, 25, 23, 252/49.5, 49.3; 72/42

[56] References Cited

U.S. PATENT DOCUMENTS

| | | | |
|---|---|---|---|
| 2,530,838 | 11/1950 | Arozco et al. | 252/25 |
| 2,609,342 | 9/1952 | White et al. | 252/25 |
| 2,725,856 | 12/1955 | Bartleson | 252/25 |
| 3,313,728 | 4/1967 | Glasson et al. | 252/18 |
| 3,801,504 | 4/1974 | Stone | 252/30 |
| 3,804,761 | 4/1974 | Milz et al. | 252/18 |
| 3,931,020 | 1/1976 | Burgess et al. | 252/30 |
| 3,963,502 | 6/1976 | Borbely et al. | 252/30 |
| 3,983,042 | 9/1976 | Jain et al. | 252/18 |
| 4,052,323 | 10/1977 | Feneberger et al. | 252/49.5 |
| 4,104,178 | 8/1978 | Jain et al. | 252/30 |

*Primary Examiner*—Delbert E. Gantz
*Assistant Examiner*—Irving Vaughn
*Attorney, Agent, or Firm*—Norman S. Blodgett; Gerry A. Blodgett

[57] ABSTRACT

A lubricant composition comprising water, graphite, an organic thickener, sodium molybdate, and sodium pentaborate. Other additives are sodium bicarbonate, ethylene glycol, or mica. The composition is effective in the hot forging of metals, is virtually non-flammable, and generates very little atmospheric pollution during use.

9 Claims, No Drawings

WATER-BASED FORGING LUBRICANT

This is a division of patent application Ser. No. 712,702 filed Aug. 9, 1976, now U.S. Pat. No. 4,104,178, which was a continuation of patent application Ser. No. 625,592, filed Nov. 24, 1975, now U.S. Pat. No. 3,983,042.

BACKGROUND OF THE INVENTION

Forging is a process by which the shape and physical properties of metal can be changed. The process involves placing a piece of metal (normally heated) between the halves of a die and forcing the die to close by impact or pressure. The operation causes a controlled plastic deformation of the metal into the cavities of the die. This flow of material results not only in a change in shape of the metal but also increases the density and uniformity of the metal, improves its grain structure, and causes a shape-conforming grain flow. The resulting workpiece has properties which are superior to those generated by other methods, making forging essential where high performance workpieces are required.

One of the critical components of a forging system is the lubricant which separates the die from the workpiece. As with all lubricating situations, it is essential that this lubricant be effective to minimize wear of the extremely expensive forging dies and minimize expenditure of energy over a wide range and condition. Somewhat peculiar to the forging process, however, is that merely maximizing lubricity is not the only goal, since a certain degree of friction between the workpiece and die is essential to optimize the properties of the workpiece. This controlled lubricity is particularly important when it is necessary to fill deep impression dies.

As modern demand for safer and more dependable machine structures increases, the forging art is being applied to more difficult materials, at higher temperatures and pressures to form more complex shapes. Although oil-based lubricating compositions, which are effective under these extreme conditions, have been developed, their properties are found to conflict seriously with national commitments to personal safety and protection of the environment. The oil-based lubricants are normally flammable and can ignite well below common operating temperatures. Normal operation results in billowing carbonaceous smoke which is unpleasant and sometimes toxic. Furthermore, cleaning of the workpieces and dies requires solvent washes that produce large quantities of rinse which, because of the economics of recycling, and desire to protect the environment can present serious disposal problems.

Attempts at avoiding the problems inherent in the use of oil-based lubricants have generally been directed toward water-based compositions. Early attempts, involving mixtures of graphite, clay minerals, and molybdenum disulfide, were found ineffective, because they did not sufficiently wet the hot metal surfaces to provide lubrication. They were also unacceptable due to the corrosion caused by the high temperature break-up of the components. Additives and substitutions which solved one problem often created another. For example, the addition of soaps to improve wetting often caused caking in cavities and increased smoke production and odor. These and other difficulties experienced with the prior art devices have been obviated in a novel manner by the present invention.

It is, therefore, an outstanding object of the invention to provide a forging lubricant which effectively reduces the die wear and energy requirement of a forging operation.

Another object of this invention is the provision of a forging lubricant which produces an extremely low amount of air pollution.

A further object of the present invention is the provision of a forging lubricant which is simple and easy to produce and which, in use, leads to relatively less expense in overall operating costs.

It is another object of the instant invention to provide a forging lubricant which has a long storage life and is not adversely effected by reasonable storage conditions.

A still further object of the invention is the provision of a forging lubricant which is simple and safe to apply to the dies using spray equipment.

It is a further object of the invention to provide a forging lubricant which is virtually non-flamable and does not give off undesirable vapors or corrosive by-products during use.

It is a still further object of the present invention to provide a forging lubricant which has the proper combination of lubricating properties to allow predictable and effective operation of forging technique over wide ranges of workpiece shape, temperature, pressure and material.

Another object of the invention is the provision of a forging lubricant which has adequate insulating properties to prevent undesirable cooling of the workpiece by the dies.

Another object of the invention is the provision of a forging lubricant which effectively prevents workpieces from sticking in the dies after the forging operation.

Another object of the invention is the provision of a forging lubricant which is easily cleaned from the workpiece and dies, and which results in a rinse which can be easily cleaned to avoid pollution.

With the foregoing and other objects in view, which will appear as the description proceeds, the invention resides in the combination and arrangement of steps and the details of the composition hereinafter described and claimed, it being understood that changes in the precise embodiment of the invention herein disclosed may be made within the scope of what is claimed without departing from the spirit of the invention.

SUMMARY OF THE INVENTION

This invention involves a water-based lubricant for hot forging metal. The composition is virtually non-flammable and non-polluting. It comprises water, graphite, an organic thickener, sodium molybdate, and sodium pentaborate. Other additives are sodium bicarbonate and ethylene glycol, or mica.

DESCRIPTION OF THE PREFERRED EMBODIMENT

The water-based lubricant of the present invention is exemplified by the following preferred composition. Unless otherwise noted, compositions are expressed in percent of total weight.

EXAMPLE 1

| | Weight % | Weights For 50 Gallons | |
|---|---|---|---|
| Sodium carboxymethylcellulose (CMC) | 0.77 | 4 | Lbs. |
| Aqueous 30% graphite suspension (Quaker LQ-405 or Acheson 147) | 38.60 | 200 | Lbs. |
| Sodium molybdate | 5.0 | 26 | Lbs. |
| Sodium pentaborate | 3.18 | 16.5 | Lbs. |
| Sodium bicarbonate | 4.83 | 25 | Lbs. |
| Ethylene glycol | 9.02 | 46.6 | Lbs. |
| Water | 38.60 | 200 | Lbs. |
| | 100.00 | 518.1 | Lbs. |

To prepare 50 gallons of the mixture, dissolve 4 lbs. of CMC in 16 gallons (133.34 lbs.) of water and mix thoroughly. Then, dissolve 26 lbs. sodium molybdate and 16.5 lbs. of sodium pentaborate in same container. Add 200 lbs. of 30% graphite and stir. Dissolve 25 lbs. of sodium bicarbonate in mixture. Add 46.55 lbs. (5 gallons) ethylene glycol and stir until the mixture is uniform. Finally, add sufficient water (8–10 gallons) to adjust viscosity for the method of application to dies. The resulting composition is a non-polluting or minimal air polluting, water-based forging die lubricant for use on steel, stainless steel, nickel-base, and titanium-base alloys. It does not flame, has minimal smoke, and contains low sulfur (a requirement for many nickel-base alloys). It is particularly adapted for hammer (impact) forging, while substitution of 2–5 wt.% mica (referred to as Example 2) for the sodium bicarbonate and ethylene glycol results in a formula particularly adapted for press (pressure) forging.

The sodium carboxymethyl cellulose (CMC) is the preferred member of a class of suspension aids known as "organic thickeners". The organic thickener tends to hold the other components in an homogeneous mixture. The class includes alkyl celluloses, polymethylvinyl ether-maleic anhydride, alkali metal alkylcelluloses and various proprietary compositions available under the trade names "KLUCEL" (hydroxypropylcellulose) and "METHOCEL".

The graphite is preferably added to the mixture as a 20–40 wt.% suspension of graphite in water. Such suspensions are sold commercially as "LQ-405 Aquaforge" by Quaker Chemical Co. of Conshohocken, Pa. or "147" by the Acheson Colloids Company, Port Huron, Mich. The graphite acts as a solid film lubricant between the workpiece and the die.

The sodium molybdate acts as an effective liquid film lubricant between the die and metal at 1600°–2200° F. It also acts as a rust inhibitor.

The sodium pentaborate (Sodium 1:5-borate) ($Na_2O \cdot 5\ B_2O_3 \cdot 10\ H_2O$) appears to act as an adhesive to wet the hot metal surface and adhere the entire composition to the workpiece and die surfaces. It also acts as a viscous film lubricant at high temperature. The pentaborate is formed by reacting one mole of borax (Sodium 1:2-borate) ($Na_2O \cdot 2\ B_2O_3 \cdot 10\ H_2O$) with six moles of boric acid ($H_3BO_3$) or three moles of anhydrous boric acid ($B_2O_3$). This reaction can be effected in or out of the complete mixture.

Sodium bicarbonate acts as a die release to prevent the workpiece from "sticking" in the die. The bicarbonate releases $CO_2$ at forging conditions, forming a gas layer that assists in separating the workpiece from the die. In addition, it acts to prevent scale, to wet, and lubricate the surfaces.

Ethylene glycol acts with the other components to improve die release and prevent scale. It also helps to prevent freezing of the water-based mixture during storage and shipping.

The effective range of composition of the various components is:

| | Wt. % |
|---|---|
| Organic thickener | 0.5–1.5 |
| Graphite (dry) | 8–16 |
| Sodium molybdate | 4–8 |
| Sodium pentaborate | 2–5 |
| Sodium bicarbonate | 1–5 |
| Ethylene glycol | 1.0–20 |
| Water | remainder |

Testing of the lubricant of Example 1 yielded the following results.

1. Good lubricity. The coefficient of friction was measured using the "Ring Compression Test" (Male and Cockcroft J. Inst. of metals 1964–65, 92, 38) but the results were not completely conclusive. Nevertheless, observations by experienced personnel on full scale forging processes indicated excellent lubricity over a wide range of workpiece materials and forging parameter as compared to commercially available lubricants. In addition, flow stress measurements were made by upsetting 4340 steel billets. The values obtained were as low or lower than many commercially available forging lubricants tested.
2. Low sulfur. The sulfur content is much lower than conventional oil base lubricants, being in the order of 800–1300 ppm compared to 10,000–30,000 ppm in oil based lubricants.
3. Minimal air pollution. Comparative tests were run under standard conditions which collected particulate material on a millipore filter from spraying weighed samples of different lubricants with the following results:

| Lubricant | Milligrams particulate material |
|---|---|
| None | 0.1 |
| Present Invention | 1.4 |
| Commercial Water-based Lub. A | 6.5 |
| Commercial Water-based Lub. B | 19.4 |
| Standard Oil-based Lub. | 124.9 |

4. Nonsettling. Tests after the lubricant had been standing in a 55-gallon drum for several weeks indicated no heavy sludge was present on the bottom of the drum.
5. Flameless. There is insignificant flaming when the lubricant is sprayed on a die at 800° F.
6. Easy application and removal from dies. The lubricant can be sprayed or swabbed on hot dies (300°–900° F.) and adheres well when applied by an air-type or airless spray gun. It will not rust or corrode steel dies and may be readily removed by washing with a spray of water.
7. Good scale removal and die release characteristics. The ethylene glycol addition results in scale removal characteristics equivalent to that of oil when used on a forging. The ethylene glycol in combination with the sodium bicarbonate also provides a gas cushion at the die surface which aids in part removal from the hammer dies.

8. Effective lubrication of parts with widely different sizes and shapes. This lubricant has been used effectively on production parts with flat simple shapes and parts with ribs, bosses, shafts, etc. of complex shape. These parts have varied in weight from 20 pounds to 5,000 pounds.

While it will be apparent that the illustrated embodiments of the invention herein disclosed are well calculated adequately to fulfill the objects and advantages primarily stated, it is to be understood that the invention is susceptible to variation, modification, and change within the spirit and scope of the subjoined claims.

The invention having been thus described, what is claimed as new and desired to secure by Letters Patent is:

1. A forging lubricant, comprised of a water base and at least a minor effective amount of sodium molybdate.

2. A forging lubricant as recited in claim 1, including at least a minor effective amount of an organic thickener.

3. A forging lubricant as recited in claim 1, including at least a minor effective amount of graphite.

4. A forging lubricant as recited in claim 1, including at least a minor effective amount of sodium pentaborate.

5. A forging lubricant as recited in claim 1, including at least a minor effective amount of sodium bicarbonate.

6. A forging lubricant as recited in claim 1, including at least a minor effective amount of sodium bicarbonate and at least a minor effective amount of ethylene glycol.

7. A forging lubricant as recited in claim 1, including at least a minor effective amount of ethylene glycol.

8. A forging lubricant as recited in claim 1, including at least a minor effective amount of mica.

9. A forging lubricant as recited in claim 1, wherein the water base is present as approximately 38.60 wt.%, the sodium molybdate is present as approximately 5.0 wt.%.

* * * * *